US006571425B2

(12) United States Patent
Vystrcil et al.

(10) Patent No.: US 6,571,425 B2
(45) Date of Patent: Jun. 3, 2003

(54) METHOD OF LINKAGE AND LOCKING OF CONNECTING COUPLING MEMBER TO NOZZLE BASE OF A VACUUM CLEANER

(75) Inventors: Robert A. Vystrcil, Garrettsville, OH (US); Ruskan Iskaliev, Lyndhurst, OH (US); Craig Barbeck, N. Royalton, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/824,603

(22) Filed: Apr. 2, 2001

(65) Prior Publication Data

US 2002/0138940 A1 Oct. 3, 2002

(51) Int. Cl.[7] ..... A47L 9/24
(52) U.S. Cl. ..... 15/412; 15/351
(58) Field of Search ..... 15/327.1, 327.2, 15/327.6, 327.7, 351, 412

(56) References Cited

U.S. PATENT DOCUMENTS

| | | | | | |
|---|---|---|---|---|---|
| 284,146 | A | | 8/1883 | Russell et al. | |
| 1,940,244 | A | * | 12/1933 | Carlstedt | 15/327.7 |
| 2,096,891 | A | * | 10/1937 | Fredlund | 417/423.2 |
| 2,176,139 | A | * | 10/1939 | Lofgren | 251/145 |
| 2,400,217 | A | * | 5/1946 | White | 15/319 |
| 2,898,621 | A | * | 8/1959 | Vance | 15/324 |
| 3,634,905 | A | * | 1/1972 | Boyd | 15/350 |
| 3,674,287 | A | | 7/1972 | Selley | |
| 3,869,751 | A | * | 3/1975 | Boyd et al. | 15/334 |
| 4,174,858 | A | * | 11/1979 | Brooks | 285/7 |
| 4,222,753 | A | | 9/1980 | Mills | |
| 4,449,737 | A | | 5/1984 | Specht | |
| 4,688,833 | A | | 8/1987 | Todd | |
| 4,708,370 | A | | 11/1987 | Todd | |
| 5,464,460 | A | | 11/1995 | Bosses | |
| 5,555,929 | A | | 9/1996 | Ishikawa | |
| 5,784,757 | A | * | 7/1998 | Cipolla | 15/351 |
| 6,108,865 | A | | 8/2000 | Veser et al. | |

* cited by examiner

*Primary Examiner*—Terrence R. Till
(74) *Attorney, Agent, or Firm*—Fay, Sharpe, Fagan, Minnich & McKee, LLP

(57) ABSTRACT

An upright vacuum cleaner (10) includes an upper housing (12) and a nozzle base (14). An underside (20) of the nozzle base includes a main suction opening (26) formed therein which is in fluid communication with the upper housing via a hose assembly (28). The hose assembly is coupled to the nozzle suction opening via a coupling member (40). The coupling member is substantially cylindrical in shape and is dimensioned to be inserted into a receiving portion (42) of the nozzle base. The coupling member includes a first tapered end (60) dimensioned to be frictionally fit within a suction inlet (44) of the receiving portion. A second end (62) of the coupling member is configured to be supported on a rear wall (50) of the receiving portion. A quarter turn thread segment (72) is disposed on the coupling member's peripheral surface. Upon rotation of the coupling member, the thread segment threadingly cooperates with the rear wall of the receiving portion so that the coupling member is urged into a friction fit seal with inlet opening (44). A finger (70) is provided on the peripheral surface of the coupling member to assist in rotating the coupling member.

24 Claims, 6 Drawing Sheets

METHOD OF LINKAGE AND LOCKING OF CONNECTING COUPLING MEMBER TO NOZZLE BASE OF A VACUUM CLEANER

BACKGROUND OF THE INVENTION

1. Field of Invention

The present invention relates to the art of vacuum cleaners. More particularly, the present invention relates to an improved coupling member for an upright vacuum cleaner configured to connect a suction opening in the vacuum's nozzle base to a hose assembly at least partially disposed in the vacuum's upper housing portion.

2. Discussion of the Prior Art

Known upright vacuum cleaners include an upper housing and a nozzle base. Typically, the upper housing and nozzle base are pivotally or hingedly connected through the use of trunnions or another suitable hinge assembly, so that the upper housing pivots between a generally vertical storage position and an inclined operating position. The upper housing includes a handle extending upward therefrom which enables an operator to grasp and maneuver the vacuum.

During vacuuming operations, the nozzle base travels across the floor, carpet, or other subjacent surface being cleaned. An underside of the nozzle base includes a main suction opening formed therein which generally communicates with the upper housing through a hose assembly. A rotating brush assembly is positioned in the region of the nozzle's main suction opening for contacting and scrubbing the surface being cleaned and to facilitate movement thereacross. A vacuum or suction source is provided in the upper housing for generating the required suction airflow for cleaning operations.

In a typical upright vacuum cleaner, the hose assembly is coupled to the nozzle suction opening via a connecting or coupling assembly. Known coupling assemblies include conventional fasteners, clamps, brackets, and the like. These types of coupling assemblies have several disadvantages. First, they generally require numerous components which add to the complexity and cost of the assembly. A coupling assembly having several components takes more time to put together, thus increasing the cost of labor. Also, the increased components are themselves more expensive. Moreover, these additional components require added housing clearance in the nozzle base which undesirably increases the size of the vacuum cleaner. Finally, known coupling assemblies are manufactured with tolerances which result in tolerance stack-up. Assemblies with tolerance stack-up have sealing problems.

Accordingly, a need exists in the art to provide a two piece coupling assembly that is simple to assemble without fasteners or tools and has optimal sealing capabilities. The present invention achieves such objectives and others.

SUMMARY OF THE INVENTION

In accordance with one aspect of the present invention, an upright vacuum cleaner includes a nozzle base having a suction inlet and an upper housing hingedly connected to the nozzle base. The upper housing is selectively moveable between a generally vertical position and a generally inclined position. A tube assembly is disposed at least partially within the upper housing. A receiving portion is located within the nozzle base. A coupling member is configured to be received by the receiving portion for coupling the tube assembly to the suction inlet. The coupling member has a thread segment disposed on its outer surface dimensioned to cooperate with a surface of the receiving portion. The thread segment and cooperating surface of the receiving portion are dimensioned to urge the coupling member into a friction fit seal with the suction inlet upon less than one full rotation of the coupling member.

In accordance with another aspect of the present invention, a coupling member for connecting a hose assembly to a nozzle base of an upright vacuum cleaner includes a substantially toroidal body portion having a first axial end, a second axial end, an outer sidewall, and a channel extending therethrough. The first axial end of the body is tapered. A thread segment is disposed on the peripheral sidewall of the body and extends less than 360° around the outer sidewall of the body. The thread segment is dimensioned to rotatingly cooperate with an associated surface of the nozzle base for urging the coupling member into a friction fit seal with the associated surface.

In accordance with yet another aspect of the present invention, a method of connecting a tube assembly of an upright vacuum cleaner to an opening in a nozzle base of the vacuum cleaner includes providing a coupling member having a substantially cylindrical body portion with a thread segment extending less than 360° around an outer surface of the body portion. Next, the coupling member is positioned within a receiving portion disposed in the vacuum cleaner's nozzle base so that a first tapered end of the coupling member is fitted within a suction inlet of the nozzle base. The coupling member is then rotated less than one full rotation so that the thread segment rotatingly cooperates with a surface of the receiving portion. The tapered end of the coupling member is urged into a friction fit seal with the suction inlet of the nozzle base through continued rotation of the coupling member.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
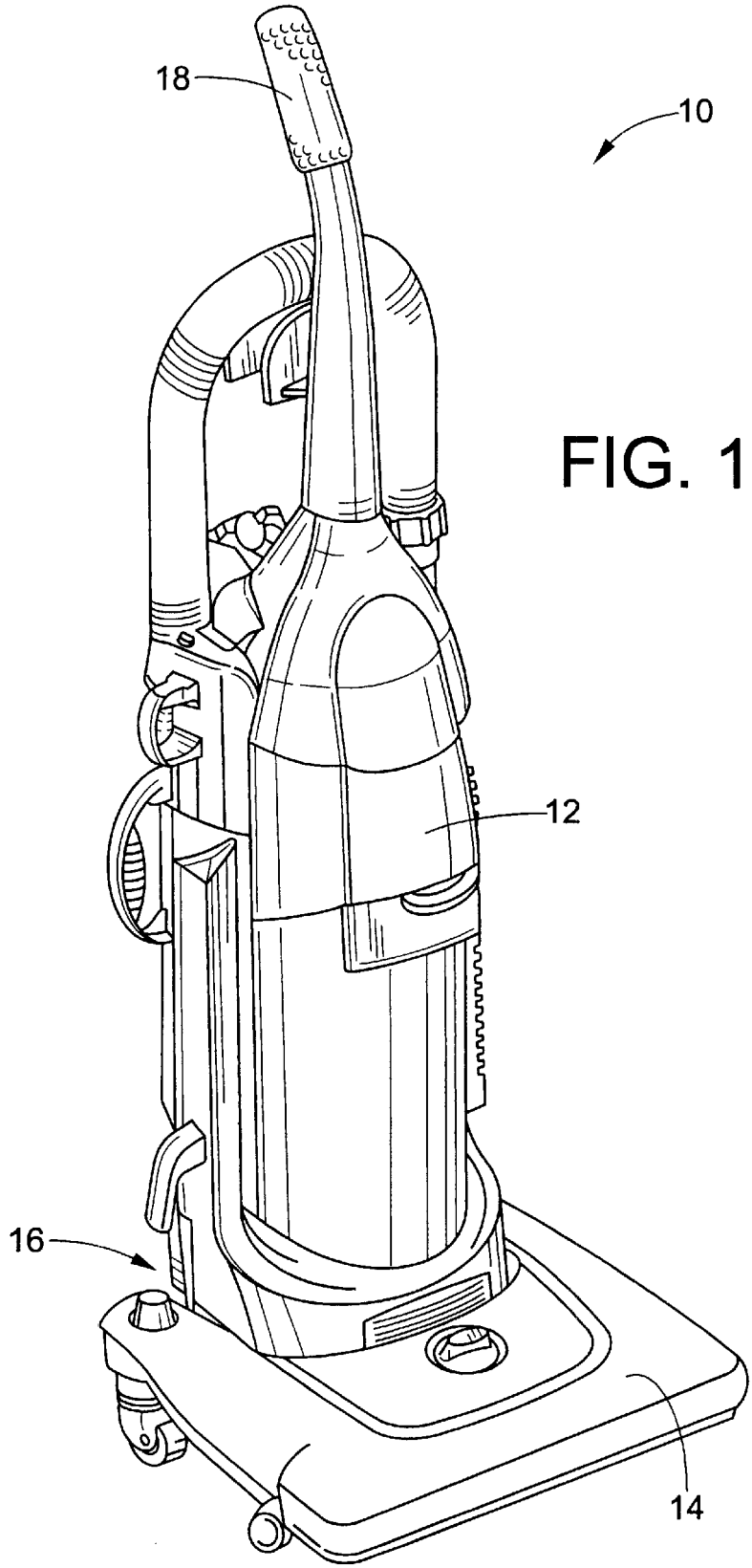
FIG. 1 is a perspective view of an upright vacuum cleaner in accordance with a preferred embodiment of the present invention.

Referring now to the FIGURES, wherein showings are for purposes of illustrating a preferred embodiment of the invention only and not for purposes of limiting the same, FIG. 1 illustrates an upright vacuum cleaner 10 including an upper housing 12 and a nozzle base 14. The upper housing and nozzle base are pivotally or hingedly connected through the use of trunnions or another suitable hinge assembly 16 so that the upper housing pivots between a generally vertical storage position (as shown) and an inclined operating position. Both the upper housing and nozzle base are preferably made from conventional materials such as molded plastics and the like. The upper housing 12 includes a handle 18 extending upward therefrom which enables an operator of the vacuum 10 to grasp and maneuver the vacuum.

Figure 2:
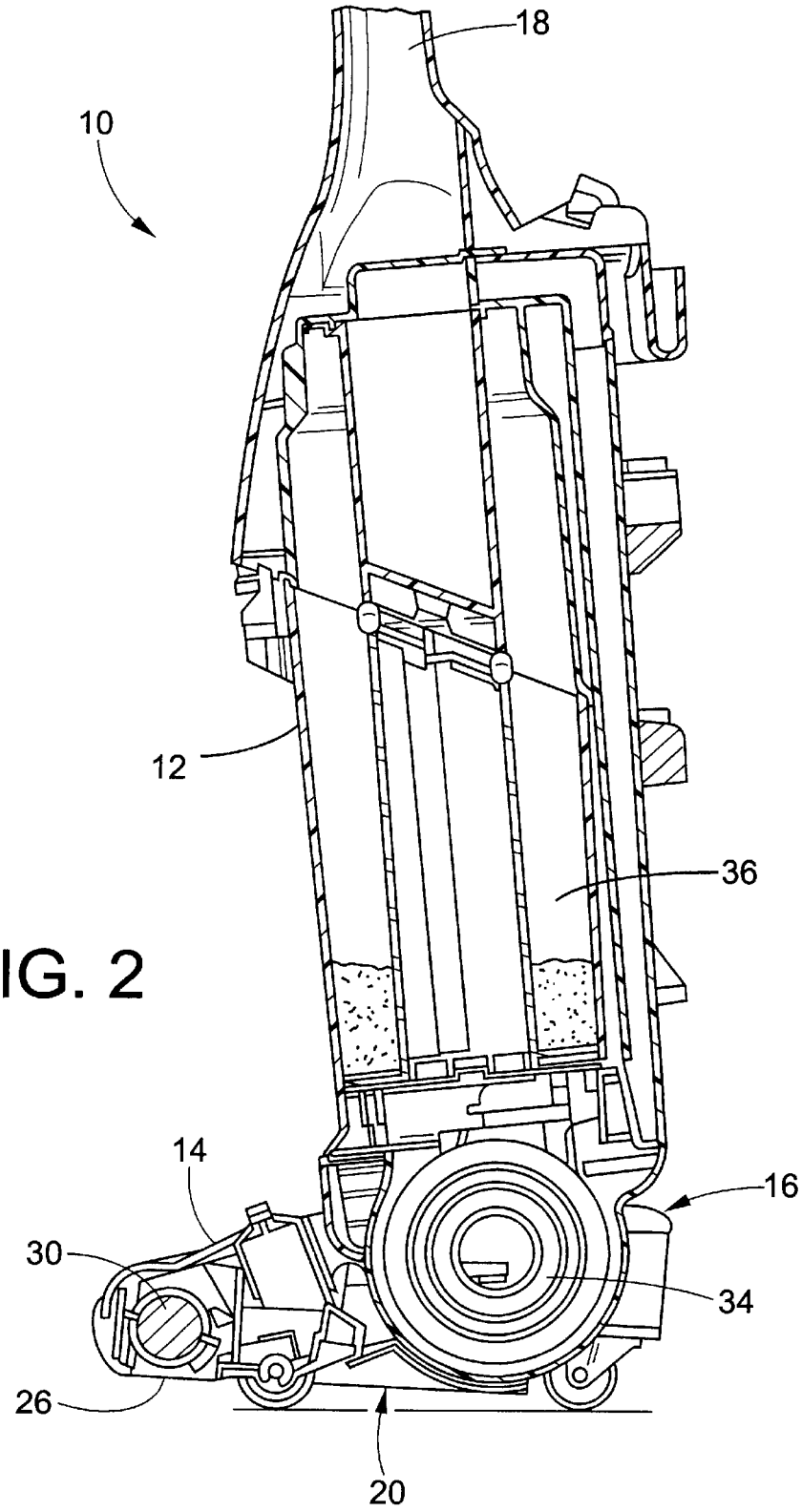
FIG. 2 is an enlarged right side elevational view in cross section of the vacuum cleaner of FIG. 1.
Figure 3:
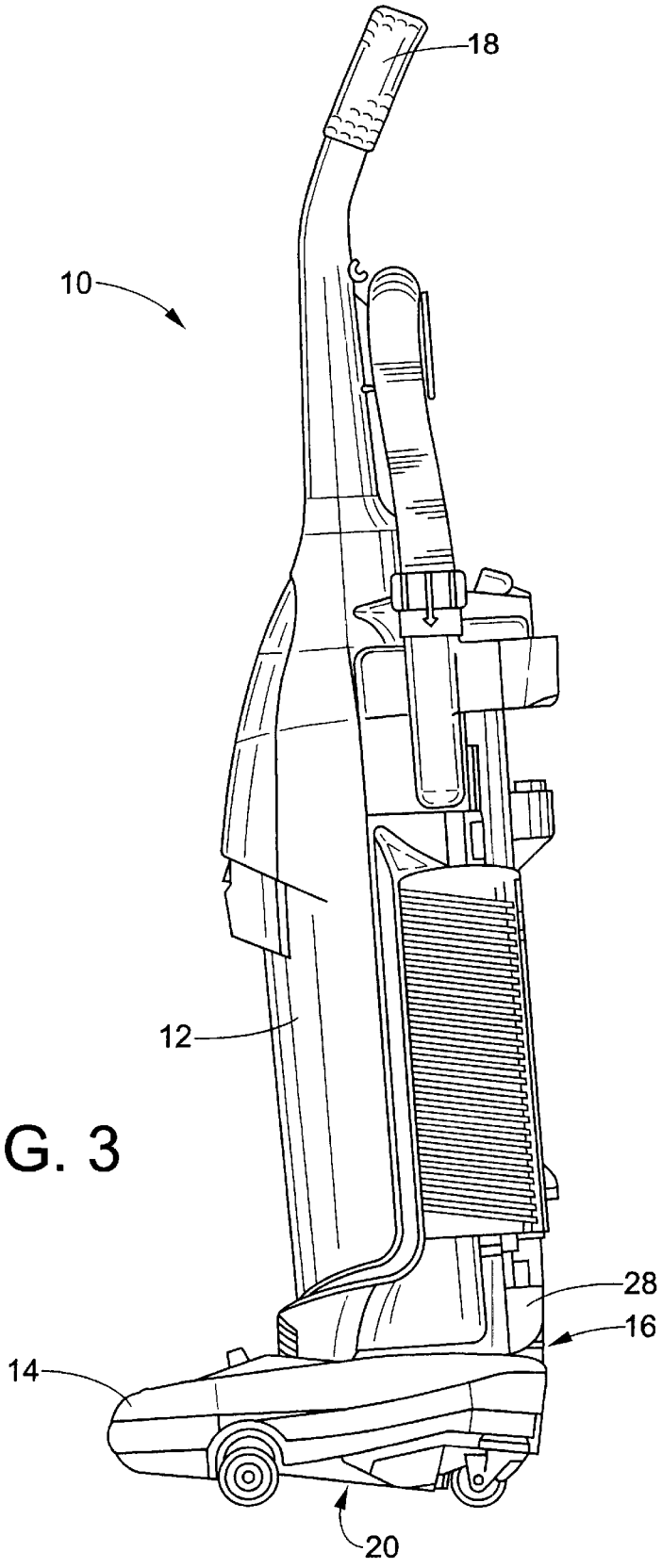
FIG. 3 is a right side elevational view of the vacuum cleaner illustrated in FIG. 1.

During vacuuming operations, the nozzle base 14 travels across the floor, carpet, or other subjacent surface being cleaned. With reference also to FIGS. 2 and 3, an underside 20 of the nozzle base includes a main suction opening 26 formed therein which extends substantially across the width of the front end of the nozzle base. As is known, the main suction opening 26 is in fluid communication with the upper housing 12 through a hose assembly 28 (see FIG. 3). A rotating brush assembly 30 is positioned in the region of the nozzle's main suction opening 26 for contacting and scrubbing the surface being cleaned and to facilitate movement thereacross. A vacuum or suction source 34 is provided in the upper housing for generating the required suction airflow for cleaning operations. A suitable suction source, such as the one shown, includes an electric motor and fan assembly.

In operation, the upright vacuum cleaner 10 is maneuvered via handle 18 so that the nozzle base 14 is slid across a suitable subjacent surface. The suction force generated from the suction source 34 causes dirt, dust, and the like to travel through suction opening 26 and into hose assembly 28. The hose assembly is in fluid communication with a dirt collection container 36 where the dirt, dust, and other matter are ultimately disposed. The hose assembly 28 is generally coupled to the nozzle suction opening 26 via a connecting or coupling member disposed between a first end of the hose assembly and the nozzle suction opening. The present invention is directed to an improved coupling member.

Figure 4:
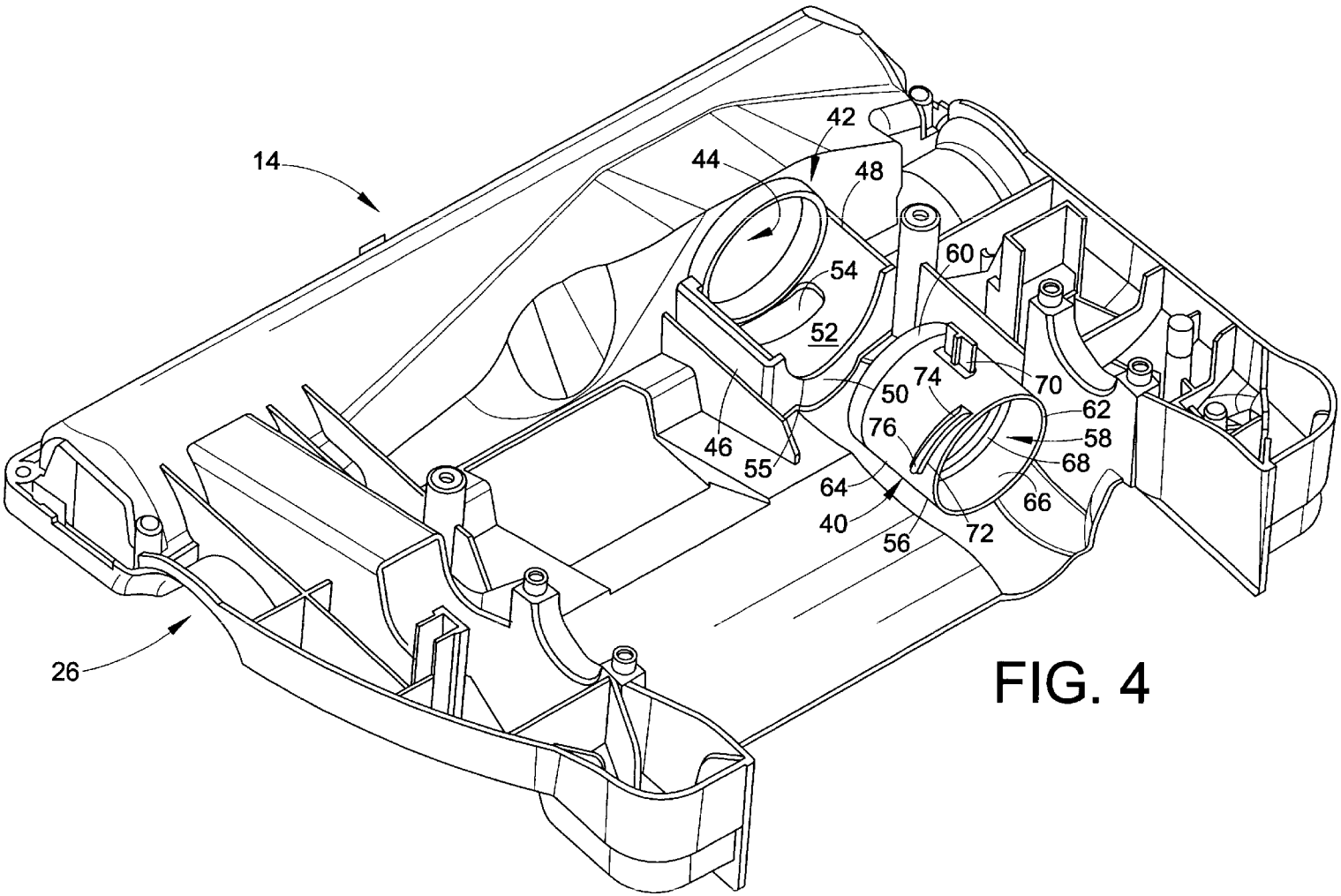
FIG. 4 is a schematic perspective view of a nozzle base and coupling member of the vacuum cleaner illustrated in FIG. 1 before the coupling member has been connected to the nozzle base.
Figure 5:
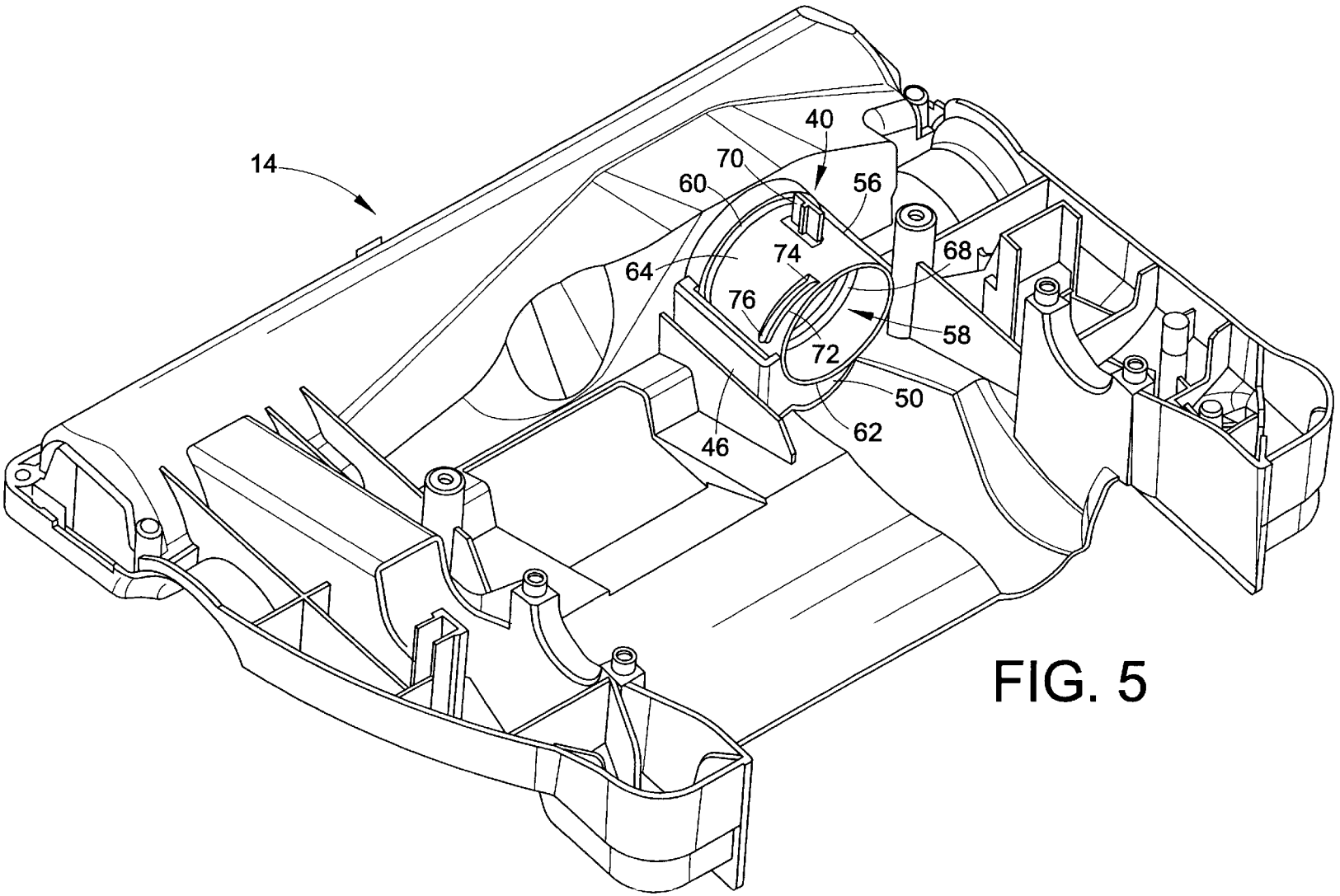
FIG. 5 is a schematic perspective view of the nozzle base and coupling member of FIG. 4 upon initial insertion of the coupling member into a receiving portion of the nozzle base.
Figure 6:
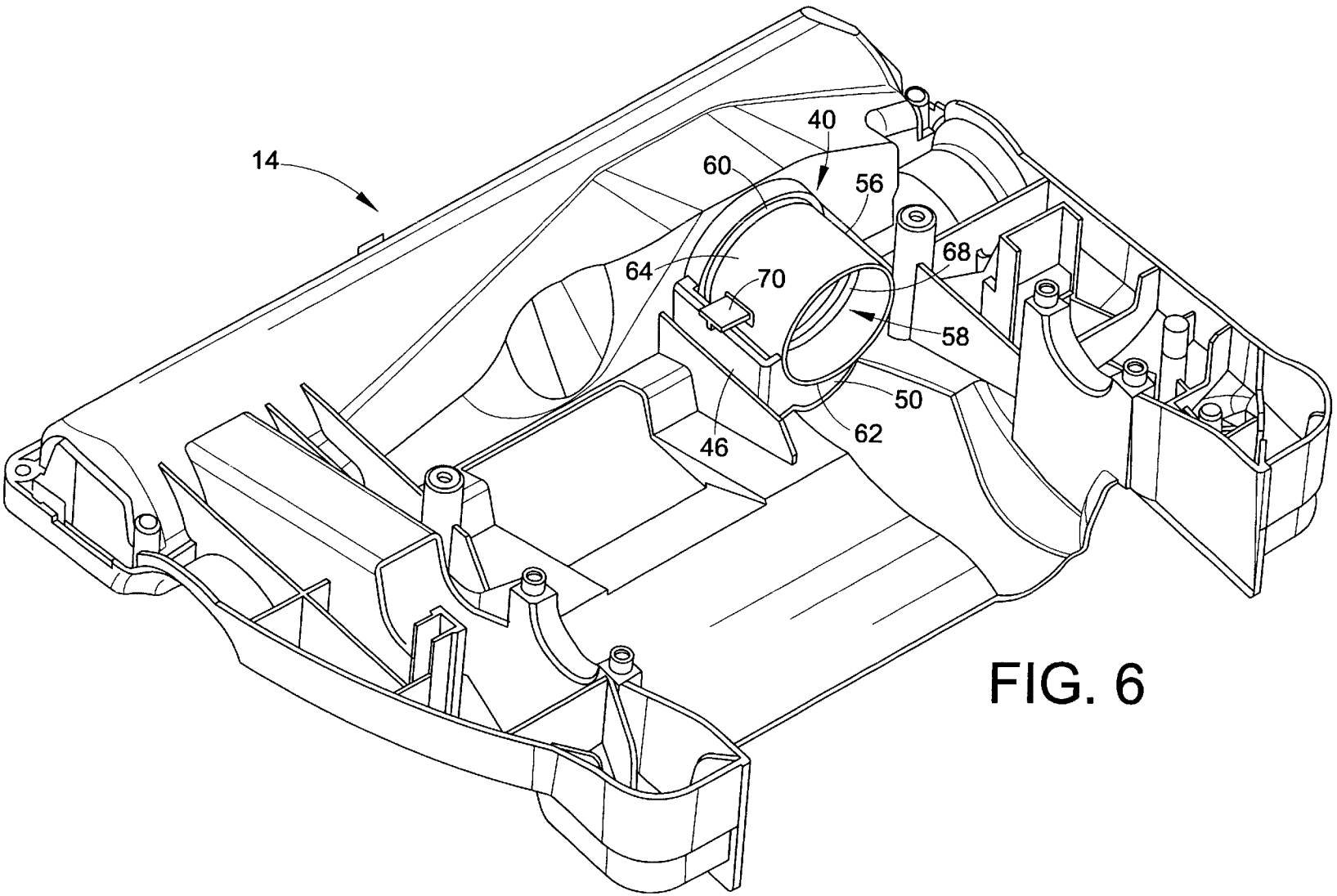
FIG. 6 is a schematic perspective view of the nozzle base and coupling member of FIG. 4 after the coupling member has been attached to the nozzle base.

With reference to FIGS. 4–6, a nozzle base 14 and coupling member 40 are shown in accordance with a preferred embodiment of the present invention. The nozzle base 14 includes a receiving portion 42 (see FIG. 4) for receiving the coupling member 40. The receiving portion includes a suction inlet 44 for directing dust, dirt and the like from the suction opening 26 to the hose assembly 28 (FIG. 3). As shown, the suction inlet 44 is substantially circular in shape and is located off-center from a midpoint of the nozzle opening. However, it must be appreciated that the suction inlet may be disposed at any suitable position relative to the nozzle opening's midpoint, such as at the nozzle opening's midpoint. Positioning the suction inlet 44 at the nozzle opening's midpoint equalizes the suction force applied to the left and right of the suction inlet.

The receiving portion further includes opposed sidewalls 46, 48, a rear wall 50 opposite inlet 44, and a bottom wall 52. The bottom wall 52 of the receiving portion 42 is preferably concave and defines an opening 54. A top edge 55 of the rear wall 50 is substantially semicircular in shape so as to form a seat to at least partially support the coupling member. The rear wall top edge is smaller in diameter than the diameter of the bottom wall 52. Sidewall 48 is preferably shorter in length than sidewall 46 so that rear wall 50, extending therebetween, is angled with respect to a plane perpendicular to sidewall 46. In this way, the rear wall top edge 55 forms a camming edge.

The coupling member 40 is substantially cylindrical or toroidal in shape and includes a body portion 56 having a passage or duct 58 extending axially therethrough. The body portion includes a first axial end 60, a second axial end 62, and an outer surface 64. The first axial end is dimensioned to frictionally fit within the suction inlet 44 of the receiving portion 42 and the second axial end is dimensioned to receive an end of the hose assembly 28. The first axial end 60 of the coupling member 40 is tapered, thus having a smaller diameter than the second axial end 62 of the coupling member. An inner surface 66 of the coupling member preferably includes a plurality of threads 68 for threadably connecting the coupling member to one end of the tube assembly 28. For this purpose, the tube is ribbed as is known in the art. It must be understood, however, that any suitable tube-to-coupling member connecting arrangement is within the scope and intent of the present invention. For example, clips, fasteners, adhesives, and the like are also contemplated. The coupling member may be made from any suitable material, such as molded plastics and the like.

With particular reference to FIGS. 4 and 5, a projection or finger 70 is disposed on the outer surface 64 of the coupling member. The finger is preferably disposed at an intermediate portion of the coupling member's outer surface. A thread segment 72 is also disposed on the outer surface of the coupling member. The thread segment is dimensioned to rotatably cooperate with the edge 55 of the rear wall 50 of the receiving portion 42. The thread segment 72 preferably extends less than 360° around the outer surface of the coupling member. In a most preferred embodiment, the thread segment extends across less than one quarter the outer surface of the coupling member. However, it must be appreciated that the thread segment may extend across any suitable length of the coupling member's outer surface.

The thread segment 72 includes a first end 74 disposed adjacent second axial end 62 and a second end 76 disposed inwardly from second axial end. Accordingly, from first end 74, the thread segment extends increasingly further away from the coupling member's second axial end 62. In other words, the thread segment is angled with respect to a plane perpendicular to the coupling member's second axial end to provide a camming action. Finger 70 is preferably disposed closer to the thread segment's first end 74 than the thread segment's second end 76.

In operation, the coupling member 40 is inserted into the receiving portion 42 of the nozzle base so that the coupling member's first axial end 60 is received by the suction inlet 44 and the coupling member's second axial end 62 is supported by rear wall 50 (see FIG. 2). While in the initial insertion position, as shown in FIG. 5, the thread segment 72 is disposed above the sidewalls 46, 48 of the receiving portion 42. In an initial insertion orientation, the finger 70 can be located at the 12 O'clock position.

After insertion, the coupling member is rotated in the counterclockwise direction using finger 70 until finger 70 is located adjacent sidewall 46. Upon rotation, thread section 72 cams on the rear wall edge 55 to urge the coupling member toward the suction inlet 44. Continued rotation urges the first tapered end 60 of the coupling member into a tight, friction fit seal with the suction inlet 44. The coupling member can be turned less than one quarter of a turn or less than 90° in order to achieve a suitable friction fit seal in a rapid manner for ease of assembly. However, the present invention also contemplates larger rotations.

It is the relationship between the thread segment 72 and the rear wall edge 55 of the receiving portion, during rotation of the coupling member, which enables the coupling member to achieve a suitable seal with the suction inlet 44.

The thread segment and rear wall edge are dimensioned and shaped so that they engage one another upon rotation of the coupling member in order to generate a camming action therebetween. The camming action urges the tapered end 60 of the coupling member into suction inlet 44 until a tight seal is achieved.

The coupling member 40 of the present invention provides several advantages over the current construction for securing a hose end to a nozzle base. Currently clamps, brackets, screws, and the like, are needed to secure a hose end to the nozzle base. Such construction requires additional housing clearances to accommodate these extra components. Moreover, these assemblies require an increased assembly time. The coupling member of the current invention requires minimal housing space and no extra components. More specifically, there is no need for fasteners, clamps or brackets to secure the coupling member to the nozzle receiving portion.

Because there is only one component to install, and that can be done without tools, the assembly time is significantly decreased. This is especially so because that member only requires a limited rotation to fully engage the nozzle base in a sealed manner. The decreased number of components also reduces labor and associated costs. As mentioned, the coupling member of the present invention is extremely simple to install. It merely requires insertion of the coupling member into the receiving portion 42 and rotation of the coupling member less than 180°, more particularly about 90°. This decreases assembly time considerably, thereby increasing production rates and reducing labor costs. Finally, the coupling member of the present invention creates an improved seal and reduces tolerance stack-up.

The invention has been described with reference to a preferred embodiment only. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An upright vacuum cleaner comprising:

a nozzle base having a suction inlet;

an upper housing hingedly connected to the nozzle base, the upper housing being selectively moveable between a generally vertical position and a generally inclined position;

a tube assembly disposed at least partially within the upper housing;

a receiving portion located within the nozzle base; and a coupling member configured to be received by the receiving portion for coupling the tube assembly to the suction inlet, the coupling member having a thread segment disposed on its outer surface dimensioned to cooperate with a surface of the receiving portion, the thread segment and the cooperating surface of the receiving portion being dimensioned to urge the coupling member into a friction fit seal with the suction inlet upon less than one full rotation of the coupling member.

2. The upright vacuum cleaner according to claim 1, wherein the thread segment extends across less than one half the perimeter of the coupling member.

3. The upright vacuum cleaner according to claim 1, wherein the thread segment extends across less than one quarter the perimeter of the coupling member.

4. The upright vacuum cleaner according to claim 3, wherein the thread segment and cooperating surface of the receiving portion are dimensioned to urge the coupling member into a friction fit seal with the inlet area upon less than a half rotation of the coupling member.

5. The upright vacuum cleaner according to claim 1, wherein the coupling member is substantially cylindrical including a first axial end and a second axial end, the first axial end being tapered.

6. The upright vacuum cleaner according to claim 1, wherein the coupling member includes a finger extending from its outer peripheral surface for assisting in rotation of the coupling member.

7. The upright vacuum cleaner according to claim 1, wherein a first axial end of the coupling member is tapered and dimensioned to frictionally fit within the suction inlet and a second axial end of the coupling member is dimensioned to be supported on a rear wall of the receiving portion, the cooperating surface of the receiving portion being an inner surface of the receiving portion's rear wall.

8. The upright vacuum cleaner according to claim 1, wherein the coupling member is substantially toroidal having a duct extending axially therethrough, an inner surface of the coupling member having a plurality of threads for threadably connecting the coupling member to the tube assembly.

9. The upright vacuum cleaner according to claim 1, wherein the thread segment is angled with respect to a plane perpendicular to an axial end of the coupling member.

10. A vacuum cleaner comprising:

a nozzle base;

a coupling member for connecting a hose assembly to said nozzle base, the coupling member comprising:

a substantially toroidal body portion having a first axial end, a second axial end, an outer sidewall, and a duct extending therethrough, said first axial end of said body being tapered; and, a thread segment disposed on the outer sidewall of the body and extending less than 360° around a periphery of the outer sidewall of the body, the thread segment being dimensioned to rotatingly cooperate with an associated surface of the nozzle base for urging the coupling member into a friction fit seal with the associated surface.

11. The vacuum cleaner according to claim 10, wherein the thread segment extends less than 180° around the periphery of the outer sidewall of the body portion.

12. The vacuum cleaner according to claim 10, wherein the thread segment extends less than 90° around the periphery of the outer sidewall of the body portion.

13. The vacuum cleaner according to claim 10, further including a finger disposed on the peripheral sidewall of the body portion for assisting in rotation of the coupling member.

14. The vacuum cleaner according to claim 10, wherein an inner sidewall of the body portion includes a plurality of threads for threadably connecting the coupling member to an associated tube assembly.

15. The vacuum cleaner according to claim 10, wherein the thread segment is angled with respect to a plane perpendicular to an axial end of the body portion.

16. A vacuum cleaner comprising:

a suction nozzle located in a housing;

a filter chamber;

a conduit fluidly connecting said suction nozzle to said filter chamber, said conduit having a first end and a second end;

a connector mounted on said first end of said conduit, said connector comprising an outer surface including a thread segment; and, a receiving portion located on said housing and communicating with said suction nozzle, said receiving portion comprising a wall having an edge which cooperates with said thread segment in order to cammingly engage said connector with said receiving portion.

17. The vacuum cleaner of claim 16 wherein said receiving portion wall edge comprises a thread segment which engages said thread segment of said connector.

18. The vacuum cleaner of claim 16 wherein said connector further comprises a first end and a second end and wherein said receiving portion further comprises a duct section which is sized to accommodate said connector first end.

19. The vacuum cleaner of claim 18 wherein said connector first end is tapered.

20. The vacuum cleaner of claim 16 wherein said connector further comprises a finger located on said outer surface.

21. A vacuum cleaner comprising:

a nozzle base and an upright housing pivotally connected thereto;

a coupling member for connecting a hose assembly communicating with said upright housing to said nozzle base;

said coupling member comprising a substantially cylindrical body portion having a first axial end and a second axial end, said first axial end being tapered;

said cylindrical body portion having a thread segment extending less than 360° around an outer surface of the body portion; and a finger extending from said outer surface for assisting rotation of said coupling member.

22. The vacuum cleaner according to claim 21, wherein said first axial end is dimensioned to frictionally fit within an associated suction inlet and said second axial end is dimensioned to be supported on a rear wall of an associated receiving portion, a cooperating surface of the associated receiving portion being an inner surface of the receiving portion's rear wall.

23. The vacuum cleaner according to claim 21, wherein the coupling member is substantially toroidal having a duct extending axially therethrough, an inner surface of the coupling member having a plurality of threads for threadably connecting the coupling member to an associated tube assembly.

24. The vacuum cleaner according to claim 21, wherein the thread segment is angled with respect to a plane perpendicular to one of said axial ends of the coupling member.

* * * * *